United States Patent [19]

Takenoya et al.

[11] Patent Number: 4,471,705

[45] Date of Patent: Sep. 18, 1984

[54] DEVICE FOR ADJUSTING LOWER THREAD TENSION OF SEWING MACHINE

[75] Inventors: Hideaki Takenoya; Eiichi Shomura; Yoshitaka Takahashi, all of Tokyo, Japan

[73] Assignee: Janome Sewing Machine Co. Ltd., Tokyo, Japan

[21] Appl. No.: 360,891

[22] Filed: Mar. 22, 1982

[30] Foreign Application Priority Data

Apr. 7, 1981 [JP] Japan ..... 56-51252

[51] Int. Cl.[3] ..... D05B 47/00

[52] U.S. Cl. ..... 112/254; 242/150 M

[58] Field of Search ..... 112/254, 59, 97, 255; 242/147 R, 147 M, 150 M, 155 M, 149

[56] References Cited

U.S. PATENT DOCUMENTS 3,996,866 12/1976 Bianchi ..... 112/254

4,377,980 3/1983 Hanyu et al. ..... 112/254

FOREIGN PATENT DOCUMENTS 866798 5/1961 United Kingdom ..... 112/254

*Primary Examiner*—Peter P. Nerbun

*Attorney, Agent, or Firm*—Michael J. Striker

[57] ABSTRACT

An electromagnetic driving device is provided at a non-rotating part of a sewing machine, thereby to rotate a first magnet via transmission mechanism. A second magnet which is opposite to the first magnet with an appropriate space thereby, is rotatably provided with respect to a bobbin carrier. These magnets keep a certain one rotating relative position by means of the opposing magnetic poles, thereby to transmit rotation of the first magnet to the second magnet. Rotation of the second magnet actuates a tension adjusting mechanism comprising a thread tension adjusting spring provided on the bobbin carrier, via the transmission mechanism so as to adjust the thread tension, and controls the electromagnetic driving device in response to designation of the thread tension. Thus, the tension of the lower thread may be adjusted when attaching the bobbin carrier in the sewing machine.

4 Claims, 8 Drawing Figures

DEVICE FOR ADJUSTING LOWER THREAD TENSION OF SEWING MACHINE

BACKGROUND OF THE INVENTION

The invention relates to a device for adjusting lower thread tension of a sewing machine, wherein an electomagnetic driving device is provided at a non-rotating part of the sewing machine, thereby rotating a first magnet via a transmission mechanism; a second magnet which is opposite to the first magnet with appropriate space, is rotatably provided with respect to a bobbin carrier; these magnets keep a certain one rotating relative position by means of the opposing magnet poles, thereby to transmit rotation of the first magnet to the second magnet; rotation of the second magnet actuates a tension adjusting mechanism which comprises a thread tension adjusting spring provided on the bobbin carrier, via the transmission mechanism so as to adjust the thread tension and controls the electromagnetic driving device in response to designation of the thread tension; and the tension of the lower thread may be adjusted, as the bobbin carrier is attached in the sewing machine.

In the prior art, the lower thread of the sewing machine is adjusted in tension by adjusting pressure of a thread tension adjusting spring provided in a bobbin carrier or a bobbin case. For doing adjustment, a sliding plate is opened and a bobbin case is taken out. Such work would be troublesome and could not be made as observing the sewing condition.

This invention is to provide a device which could adjust the thread tension by electric control, as attaching a mechanism concerned with the lower thread supply in the sewing machine.

DETAILED DESCRIPTION OF THE PREFERRED EMBODIMENT

Figure 1:
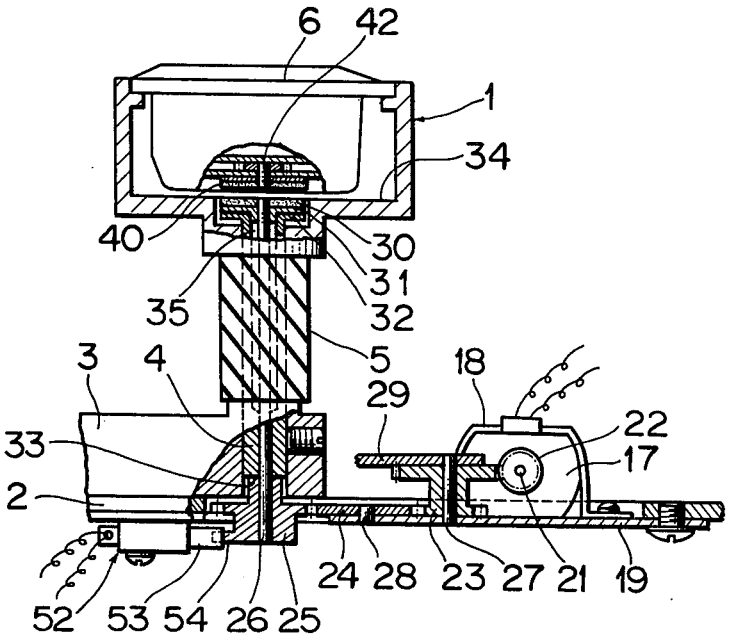
FIG. 1 is a cross sectional view, partially in section showing an embodiment for adjusting the lower thread tension according to the invention.

The invention will be explained in reference to the embodiment shown in the attached drawings. In the drawings, a loop taker 1 contains a gear 5 which rotates on a shaft 4 of the loop taker 1. The shaft is connected to a seat 3 which is integral with a machine body 2, so as to transmit rotation of a lower shaft (not shown) of the gear 5 which is in engagement with a gear (not shown) of the lower shaft.

Figure 2:
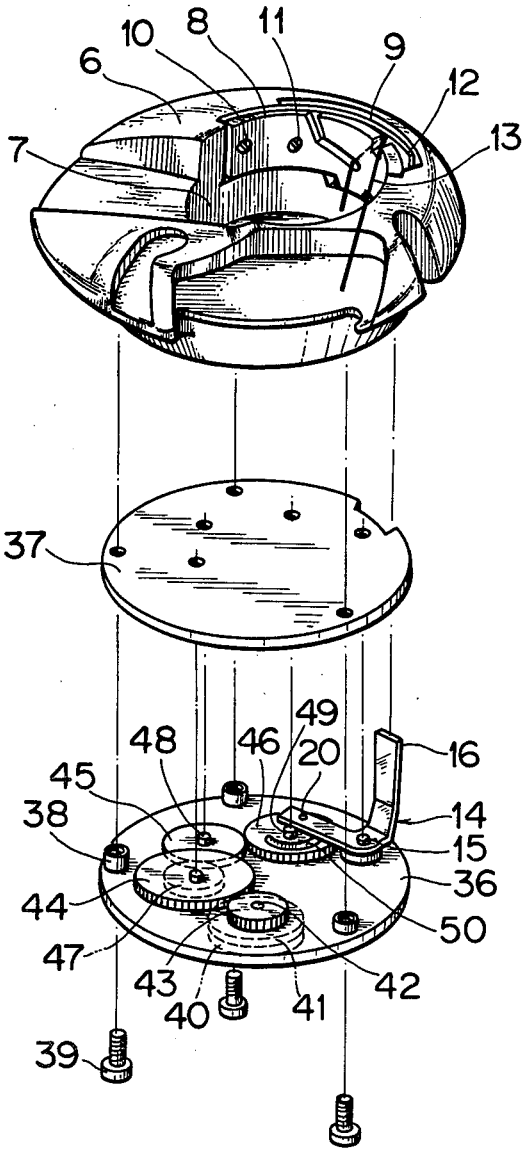

A bobbin carrier 6 is mounted within the loop taker 1, and is stationary while the latter is rotating. The bobbin carrier 6 may be removed for clearing thread dusts, etc. The bobbin carrier 6 holds a bobbin (not shown) within a cavity 7 formed in its center as shown in FIG. 2. The bobbin carrier 6 is provided with a thread tension bed 8 and a tension spring 9, held by means of a screw 10 as is conventionally done.

Figure 3:
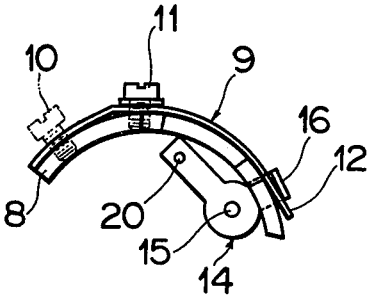

The thread tension spring 9 is, as shown in FIG. 3, has a smaller radius of curvature than the thread tension bed 8. The curve portion of the thread tension spring 9 is centrally screwed and adjusted by a thread tension screw 11, thereby making the pressure of the thread tension spring 9 moderate in relation to the thread tension had 8 up to an end part 12 of the lower thread tension spring 9. Thus, the lower thread 13 passing against the aforementioned pressure is set with an initial drawing out to tension when the sewing machine is set up. The end 12 of the spring 9 has a portion exceeds the effective point of the pressure, and extends, as shown in FIG. 3, outwardly from the curve portion of the thread tension bed 8. With respect to the end 12, a pressing lever for a thread tensioner 14 is turnably mounted about a shaft 15, so that the end 12 is pressed by a presser 16, so as to control the pressure in addition to the value of the initially set pressure.

The numeral 17 is a miniaturized motor which is an electromagnetic driving device for adjusting the thread. The motor 17 is secured by a motor plate 18 to a bed plate 19 which is integral with the machine body 2. Rotation of the motor 17 acts on a guide pin 20 of the pressing lever 14 via a later mentioned transmission mechanism so as to adjust the pressing force exerted by the spring presser 16. The numeral 21 is a motor driving shaft, and 22 is a worm gear. The numerals 23, 24 and 25 are gears which are for successively transmitting the rotation of the worm 22, by either speed reduction or at a uniform speed ratio, in order to rotate a magnet rotating shaft 26 fixed on the gear 25. The numerals 27, 28 are shafts for pivoting the gears 23, 24, respectively and 29 is a bearing.

The magnet rotating shaft 26 pivotably penetrates the center of the shaft 4, and is rotatably furnished on its top with a first magnet 30 of disc shape and a magnet disc plate 31. The first magnet 30 and magnet disc plate 31 are stopped from downward movement by an upper face 32 of the shaft 4 and stopped from upward movement by a lower face 33. The upper face of the first magnet 30 is almost at the same level as a lower surface 34 of the loop taker 1. The shaft 4 pivots the magnet rotating shaft 26 as previously mentioned, and has at its upper portion an oil storage 35 having an inner diameter sufficiently larger than the shaft 26. The oil storage 35 supplies the oil to the shaft 26.

Figure 4:
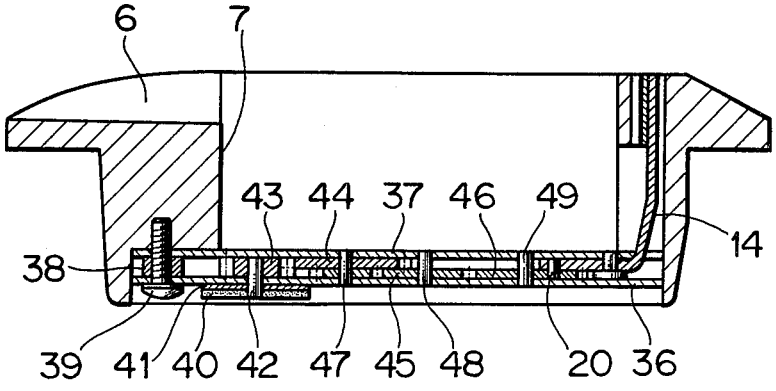
FIGS. 2 to 6 are views showing, in detail, parts to be used in the above embodiment.

The bobbin carrier 6 is furnished with a bottom plate 36 and a cover 37 which form a gear chamber, and are composed of nonmagnetic substance as shown in FIGS. 2 and 4. The gear chamber is formed by means of screws 39 with spacers 38 at three positions. Between these spacers, later mentioned gears are provided. On the lower surface of the bottom 36, a second magnet 40 of disc shape and a magnetic disc plate 41 are fixedly mounted on a magnet rotating shaft 42 at one side of the bottom plate 36, and a gear 43 is to the other side of the bottom plate 36 thus keeping the bottom plate 36 therebetween (FIG. 4) so as to prevent the magnets from vertical movement while rotatably holding them. When the bobbin carrier 6 is attached within the loop taker 1, as shown in FIG. 1, the shaft 26 and the shaft 42 are coaxial. The magnets 30, 40 act on each other to maintain a slight space therebetween, since they do not influence rotation, as later mentioned.

Figure 5:
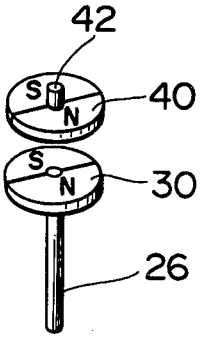

The magnets 30, 40 have, as shown in FIG. 5, polarities of N and S, and they are attracted each other at one rotation relative position shown in FIG. 5. When the first magnet 30 rotates, the second magnet 40 follows as maintaining the attracting position. The motor 17 has torque sufficient to rotate the first magnet 30 only for such a case that the second magnet 40 is forcibly stopped. The disc plates serve as yorks for auxiliarily strengthening the magnetic paths of the magnets 30, 40.

Figure 6:
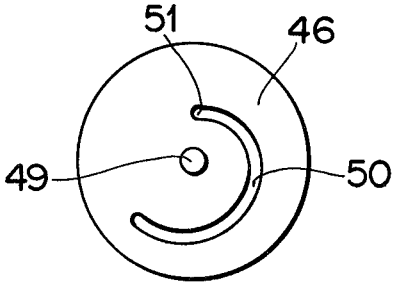

The numerals 44, 45 and 46 are gears which are for successively transmitting rotation of the gear 43 by speed reduction or at uniform speed ratio. The numerals 47, 48 and 49 are shafts which pivot these gears. The gear 46 is, as shown in FIG. 6 (omitting teeth), defined with a groove cam 50 in which a guide pin 20 of the pressure lever 14 follows to rotate the gear 46 in the clockwise direction. When the guide pin 20 engages one end portion of the cam 51, the guide pin 20 moves to the maximum a spring presser 16 of the lever 14 in the counterclockwise direction, and causes the end 12 of the thread tension spring 9 to adjust the pressure of the thread tension to the initially set value. The groove cam 50 increases the distance from the shaft 49 as it separates from the cam end 51. When the gear 46 is rotated in the counterclockwise direction from the initially set value, the pressure of the thread tension is adjusted in an increasing amount. This adjustment is made within a rotation adjusting range in which the second magnet 40 rotates 6 times.

The mumeral 52 is a switch for detecting positions and is fixed to a bed plate. An actuator 53 of the switch 52 closes, at an interval of determined small rotational angle of the gear, by means of a projection 54 formed on the gear 25. When the gear 46 is rotated to the maximum in the clockwise direction and, engages the guide pin 20, when the magnets 30, 40 are at the stable attracting position to each other as shown in FIG. 5, the stable closing condition is provided when the motor 17 rotates the first magnet against the engagement with the guide pin 20, the position of the projection 54 is adjusted when the gear 25 is mounted on the shaft 26 such that the closing is provided in the aforementioned interval of the determined rotational angle. If the motor 17 and the first magnet 30 overrun from the determined position, due to its inertia, at controlling a later mentioned initial setting, the closing condition is maintained.

Figure 7:
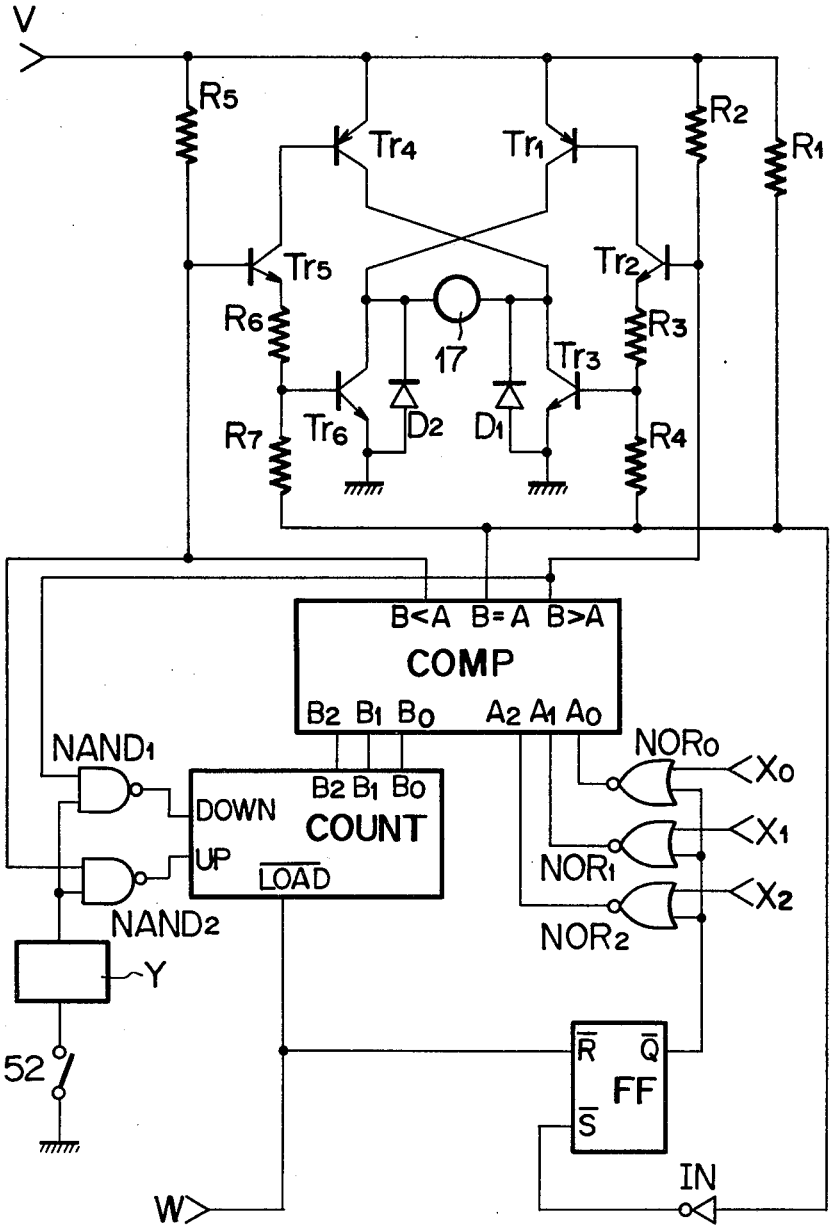
FIG. 7 is a control circuit.

FIG. 7 shows an electric control circuit diagram. The motor 17 is of the AC permanent magnetic motor in this embodiment. The motor 17 receives positive electric voltage (V) and driving power between groundings, and is controlled at "normal", "reverse" and "stop" by voltage (V) and outputs of terminals (B<A), (B=A), (B>A) of a comparator (COMP). (Tr1) to (Tr6) are transistors and (R1) to (R7) are resistors. The terminals (B<A), (B=A), (B>A) are controlled such that any one of them is H level each time and then the others are L level. When the terminal (B>A) is H level, it makes the transistors (Tr1), (Tr2), (Tr3) conductive, and electric current of the motor 17 flows from the left to the right in FIG. 7. At this time the motor 17 rotates the gear 46 in the clockwise direction to the initial setting side. This rotating direction is referred to as "reverse direction". When the terminal (B>A) is H level, it makes the transistors (Tr4),(Tr5),(Tr6) conductive to normally rotate the motor 17. (D1),(D2) are diodes and when the terminal (B=A) is H level, the transistors (Tr3) (Tr6) become conductive. Then if the motor 17 is rotated, owing to its inertia, the motor makes power generation and the short-circuit current flows via any one of the transistors and the diode in a normal direction with respect to voltage of power generation so as to brake power generation.

(FF) is a flip flop circuit of reset preference which is reset by receiving resetting pulse W at a resetting terminal (E) when supplying the electric power source. When the output terminal (B=A) of the comparator (COMP) is H level, a setting terminal ($\overline{S}$) is set by receiving the signal via an inverter (IN). A complement terminal ($\overline{Q}$) of the flip flop circuit is connected to each of one side inputs of NOR circuits (NOR2,),(NOR1),-(NOR0). The other side inputs of NOR circuits receive signals X2, X1, X0 expressed as a binary number. The codes X2, X1, X0 are the signals designating the thread tension, which are encoded by the manual operation via the switches or by the sewing condition via the computer. The outputs of the NOR circuit are connected to input terminals (A2),(A1),(A0) at one side of the comparator (COMP), and codes A2, A1, A0 meant by them are expressed as data A. (COUNT) is an up-down counter for making calculation from 0 to 7, and is reset 7 by receiving resetting pulse W at a terminal ($\overline{LOAD}$) when supplying the electric source, that is, the outputs B2, B1, B0 are rendered 1 1 1. These outputs are inputs at the other side of the comparator (COMP), and the codes B2, B1, B0 are expressed at data B at its output side. The output terminals (B<A),(B=A), (B>A) of the comparator each compare the data A and B, and if it meets inequality or equality, it is H level, and if it does not meet it is L level. When the terminal (B>A) is H level, it is connected to a base of the transistor (Tr2) in order to make reverse rotation of the motor 17, and if it is connected to an input terminal of one side of NAND circuit (NAND 1) connected to a count-down terminal (DOWN), in order to subsequently enable to count down the counter (COUNT). When the terminal (B>A) is H level, it is connected to a base of the transistor (Tr2) in order to make nomal rotation of the motor 17, and it is connected to an input terminal of one side of NAND circuit (NAND2) connected to a count-up terminal (UP), in order to subsequently enable to count up the counter (COUNT). (Y) is an edge detecting circuit which issues pulse per each time of falling signals when the position detecting switch 52 is closed, and gives it to the input terminal of the other side of NAND circuits (NAND1) (NAND2).

Figure 8:
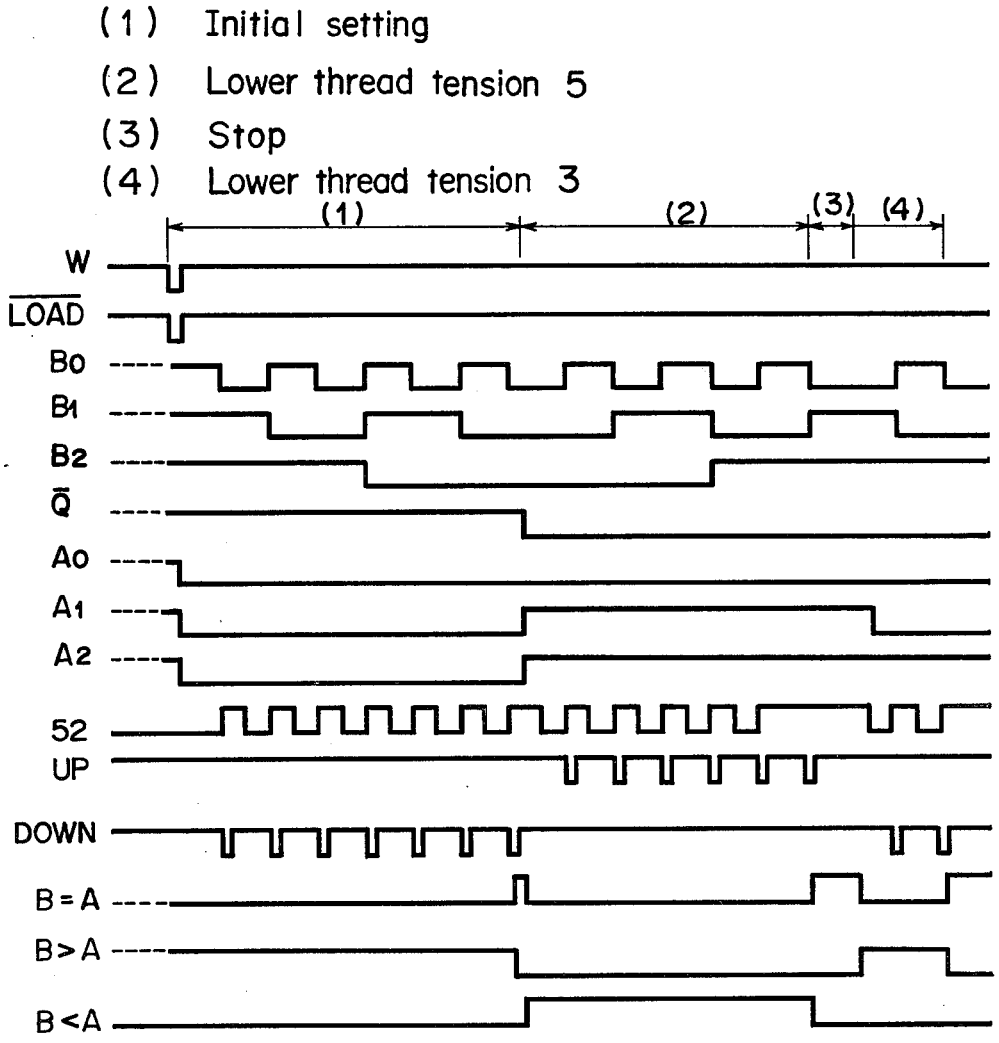
FIG. 8 is a control timing chart.

In the above mentioned structure, actuation of this embodiment will be explained with reference to FIG. 8. When supplying the power source, initial settings are made. The flip flop circuit (FF) is reset by the resetting pulse W and the counter (COUNT) is loaded 1 1 1 at the outputs B2, B1, B0. The complement output $\overline{Q}$ of the flip flop circuit (FF) is H level, whereby the inputs A2, A1, A0 on one side of the comparator (COMP) are rendered 0 0 0, i.e., A=0. The inputs B2, B1, B0 on the other side are 1 1 1, i.e., B=7. In reference to Table 1, the closing rotation number of the position detecting switch 52 is 0. Since "B>A" is H level, the transistor (Tr2) is made conductive so that the transistors (Tr1)(TR3) are also conductive and the electric current of the motor 17 flows from the left to the right in FIG. 7 and the motor rotates reversely. The input at one side of NAND circuit (NAND1) is H level and subsequently receives the closing rotation number of the switch 52 and issues it. The switch 52 is closed and opened per one rotation of the first magnet 30 and the counter (COUNT) is counted down. The second magnet 40 is at the attracting position in FIG. 5 while the first magnet 30 makes at least one rotation. Thereby, the second rotation rotates together with the first magnet 30, otherwise if the cam end 51 of the gear 46 is engaged with the guide pin 20 of the presser lever 14, the first magnet 30 rotates solely. When the closing rotation number of the switch 52 reaches 7, the outputs B2, B1, B0 of the counter (COUNT) are 0 0 0, i.e., 8=0. Since the gear 46 has the control range where the second magnet 40 makes 6 rotations, it reaches the condition where it is engaged by the guide pin 20 of the presser lever 14, until the closing rotation number of the switch 52 reaches 7, and the lower thread tension is the minimum. "B=A" is obtained, and the therminal (B>A) of the comparator (COMP) is L level and the terminal (B=A) is H level. The flip flop circuit (FF) is set. The transistors (Tr2)(Tr1) are made nonconductive and the transistors (Tr3)(Tr6) are made conductive. The power supply to the motor 17 is nullified, and the power generation due to the inertia of the motor is short-circuited via the diode (D1) and the transistor (Tr6), and is broken, and the motor is stopped almost the same time. Braking of the power generation prevents overrunning so that the switch 52 gets out from the closing condition at such time. The initial setting is finalized. With respect to designation of the tread tension, assuming that the designation value 0 is one end of the control range where the cam end 51 of the gear 46 is engaged with the guide pin 20 of the presser lever 14, and the other end is divided into 6, and the designation value 5 is at said initial setting point, in reference to Table 2, since the designating signals X2, X1, X0 of the thread tension are 1 0 1, the inputs A2, A1, A0 of the comparator (COMP) are 1 0 1, i.e., A=5, and on the other hand, being B=0, the outputs (B<A) of the comparator is H level and NAND circuit (NAND2) receives subsequently the closing rotation number of the switch 52 and issues it. The transistors (Tr5) (Tr4) (Tr6) are made conductive and the motor 17 makes the normal rotation. The second magnet 40 rotates together with the first magnet 30 and the gear 46 rotates in the counterclockwise direction, and the spring presser portion 16 of the presser lever 14 rotates in the clockwise direction and presses the end of the thread tension spring 9 so as to increase pressing force in relation with the thread tension bed 8 and increase drawing force of the lower thread 13. The first magnet makes 5 rotations to provide B=A, so that the terminal (B=A) is H level and the motor 17 is stopped. At this time, the lower thread tension corresponds to the preceding designating value 5. Assuming that designation of tension is changed to 3 from this condition, in reference to Table 3, since the designating signals X2, X1, X0 of the thread tension X2, X1, X0 are 0 1 1 and the input is A=3 and B=5, the terminal (B>A) is H level and the motor 17 rotates reversely and the counter (COUNT) is counted down, and when the first magnet makes 2 rotations, the motor stops. The lower thread tension at this time corresponds to the designating value 3.

As mentioned above, depending upon the present invention, it is possible to operate the dial and the others, and optionally adjust the lower thread tension by the signals designating the lower thread tension through the microcomputor, as attaching the bobbin carrier to the sewing machine, and the operation may be carried out without inconvenience, and the adjustments in response to the sewing conditions may be provided.

TABLE 1

| | COMP input | | COMP output | | | | |
|---|---|---|---|---|---|---|---|
| (1) | B | A | B < A | B = A | B > A | (2) | Q |
| 0 | 7 | 0 | L | L | H | (3) | H |
| 1 | 6 | 0 | L | L | H | " | H |
| 2 | 5 | 0 | L | L | H | " | H |

TABLE 1-continued

| | COMP input | | COMP output | | | | |
|---|---|---|---|---|---|---|---|
| (1) | B | A | B < A | B = A | B > A | (2) | Q |
| 3 | 4 | 0 | L | L | H | " | H |
| 4 | 3 | 0 | L | L | H | " | H |
| 5 | 2 | 0 | L | L | H | " | H |
| 6 | 1 | 0 | L | L | H | " | H |
| 7 | 0 | 0 | L | H | L | (4) | L |

NOTE:
(1) Closing rotation number of 52
(2) Rotating direction of 17
(3) Reverse rotation
(4) Stop

TABLE 2

| | COMP input | | COMP output | | | | |
|---|---|---|---|---|---|---|---|
| (1) | B | A | B < A | B = A | B > A | (2) | Q |
| 0 | 0 | 5 | H | L | L | (5) | L |
| 1 | 1 | 5 | H | L | L | " | L |
| 2 | 2 | 5 | H | L | L | " | L |
| 3 | 3 | 5 | H | L | L | " | L |
| 4 | 4 | 5 | H | L | L | " | L |
| 5 | 5 | 5 | L | H | L | (4) | L |

NOTE:
Normal rotation

TABLE 3

| | COMP input | | COMP output | | | | |
|---|---|---|---|---|---|---|---|
| (1) | B | A | B < A | B = A | B > A | (2) | Q |
| 0 | 5 | 3 | L | L | H | (3) | L |
| 1 | 4 | 3 | L | L | H | " | L |
| 2 | 3 | 3 | L | H | L | (4) | L |

What is claimed is:

1. A device for adjusting tension of a lower thread of a sewing machine, comprising a non-rotating part, an electromagnetic driving device which is provided on the non-rotating part, a first magnet to be rotated by the electromagnetic driving device, a second magnet in opposition to the first magnet with appropriate space where the first magnet and the second magnet are acting on each other, the second magnet being rotatably provided with respect to a bobbin carrier and following in rotation the first magnet at one rotating relative position therewith, a transmission mechanism provided at the bobbin carrier to transmit rotation of the second magnet, a thread tension actuator to be moved by the transmission mechanism, and a tension adjusting mechanism provided at the bobbin carrier which adjusts thread tension in response to moving amount of the thread tension actuator.

2. A device as defined in claim 1, wherein said bobbin carrier carries therein a bobbin loaded with the lower thread and is supported in the loop taker, and said second magnet is rotatably supported by the bobbin carrier, and wherein said first magnet is rotatably supported in the loop taker in a position spaced from the bobbin carrier.

3. A device as defined in claim 2, wherein said first magnet has a central rotation shaft connected by gears to said electromagnetic driving device.

4. A device as defined in claim 1, wherein said thread tension actuator includes a lever turnably mounted on the bobbin carrier and has a first arm and a second arm, and wherein said transmission mechanism includes a series of gears and a cam each rotatably mounted on the bobbin carrier, said cam being in engagement with the first arm of the lever and operated in association with the gears to cause the second arm of the lever to cooperate with the tension adjusting mechanism to thereby control the tension of the lower thread.

* * * * *